US005247952A

United States Patent [19]

Ferguson, Sr.

[11] Patent Number: 5,247,952

[45] Date of Patent: Sep. 28, 1993

[54] BOBBIN RECONDITIONING

[76] Inventor: John H. Ferguson, Sr., P.O. Box 116, Linwood, N.C. 27299

[21] Appl. No.: 760,935

[22] Filed: Sep. 17, 1991

[51] Int. Cl.[5] ..... B08B 3/02

[52] U.S. Cl. ..... 134/72; 134/113; 134/125; 134/129

[58] Field of Search ..... 134/72, 113, 125, 127, 134/129, 131; 15/302, 304; 28/292

[56] References Cited

U.S. PATENT DOCUMENTS

| | | | |
|---|---|---|---|
| Re. 19,673 | 8/1935 | McKillop . | |
| 1,711,429 | 4/1929 | Senn . | |
| 1,987,231 | 1/1935 | Engel . | |
| 2,303,048 | 11/1942 | Hudson . | |
| 2,634,489 | 4/1953 | Root, III | 28/292 |
| 2,818,873 | 1/1958 | Carlson et al. | 134/125 X |
| 2,910,992 | 11/1959 | Wilcox | 134/125 X |
| 3,090,392 | 5/1963 | Libby | 134/125 |
| 3,112,550 | 12/1963 | Bentley . | |
| 3,491,873 | 1/1970 | Fauth | 134/125 X |
| 3,579,381 | 5/1971 | Bailey et al. | 134/8 |
| 3,900,040 | 8/1975 | Graber et al. | 134/127 |
| 4,327,756 | 5/1982 | Rath | 134/72 |
| 4,479,574 | 10/1984 | Julius et al. | 134/125 X |
| 4,641,672 | 2/1987 | Lewbart | 134/62 |
| 4,667,690 | 5/1987 | Hartnig | 134/129 X |
| 4,783,887 | 11/1988 | Trias | 28/292 |
| 4,965,917 | 10/1990 | Ferguson | 28/295 |

FOREIGN PATENT DOCUMENTS

| | | | |
|---|---|---|---|
| 1236362 | 3/1967 | Fed. Rep. of Germany | 134/129 |

*Primary Examiner*—Philip R. Coe
*Attorney, Agent, or Firm*—Rhodes, Coats and Bennett

[57] ABSTRACT

A stripped bobbin treatment apparatus for inspecting, cleaning and packing bobbins which have been stripped of residual yarn includes a conveyor, an inspection station. a cleaning station and a packing station. The conveyor is in the form of a plurality of endless belts trained around sheaves which permit the bobbins to travel in non-linear paths on the conveyor. Bobbins which are not completely stripped may be redirected to a stripper for additional stripping, and bobbins which are damaged may be discarded. The cleaning station is traversed by the conveyor and includes a housing and nozzles therein for spraying water to clean the bobbins. These include nozzles mounted for pivoting reciprocation in a plane perpendicular to the path, nozzles mounted for pivoting reciprocation in a horizontal plane parallel to the path and nozzles located below the path mounted for rotation about a vertical axis to spray water upwardly through the bobbins. Side rails located over a lower bobbin flange as the bobbins are transported through the housing hold bobbins on the conveyor when impacted by water sprays. An upper belt in the housing spaced from the conveyor a distance about the height of the bobbins holds the bobbins on the conveyor even under strong water pressure. A blower in the housing blows drying air onto the bobbins. The bobbins may be removed from the conveyor for packing into transport containers.

22 Claims, 7 Drawing Sheets

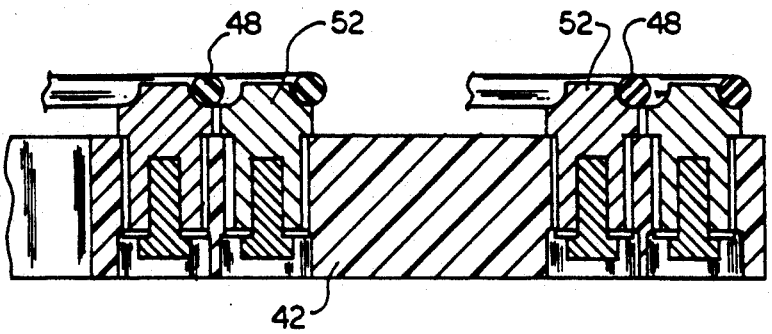
FIG. 3
FIG. 2
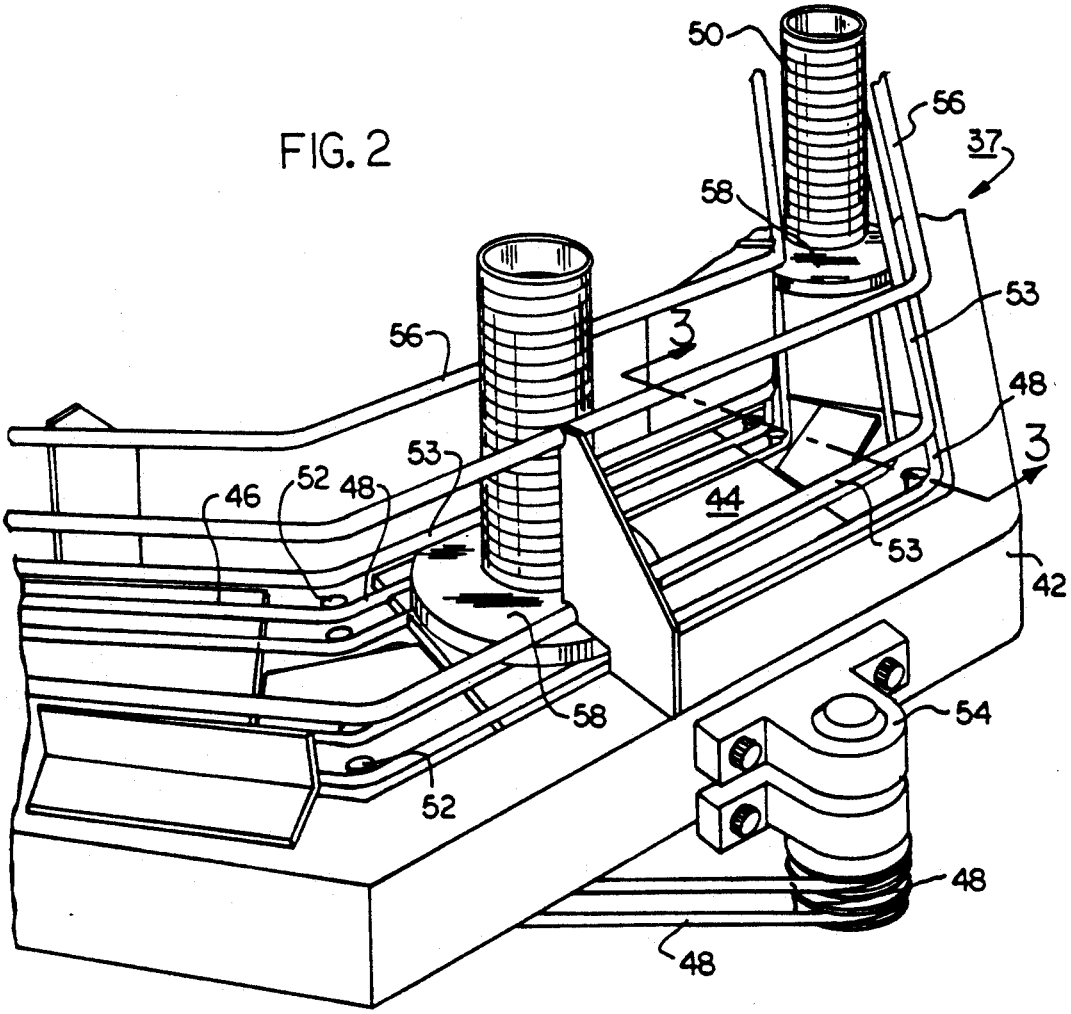

BOBBIN RECONDITIONING

BACKGROUND OF THE INVENTION

The present invention relates to improvements in bobbin reconditioning systems, particularly bobbins which have been stripped of yarn from previous uses. The reconditioning puts them into condition for reuse.

The present invention is particularly advantageously used in conjunction with the apparatus of applicant's prior U.S. Pat. No. 4,965,917 entitled "Bobbin Stripping System", the entire disclosure of which is incorporated herein by reference. The '917 patent discloses a bobbin cleaning system for removing fiberglass remnants of rovings and the like from a bobbin in order that the same can be reused. The fiberglass yarn is stored on plastic bobbins, and the residual windings of yarn to be stripped off of the bobbin are removed with a water jet cutting system. The apparatus of the '917 patent has been found to be effective to completely remove yarn from a high proportion of bobbins but a human inspection is still desirable to be sure they are completely free of residual fibers. Furthermore, the bobbins as supplied to the apparatus of the '917 patent have may have deficiencies which prevent their reuse in a glass fiber yarn manufacturing process. For example, the bobbins are sometimes nicked or otherwise damaged so as to render them unusable for further use as fiberglass bobbins. In addition, if the bobbins are soiled, the soil can fall off at a later stage of processing and damage or foul the delicate yarn and equipment used in later stage processing.

Accordingly, there is a need in the art for an apparatus and a method to recondition bobbins that have been stripped of the yarn, to weed out non-reusable bobbins such as those which are damaged or those which require more yarn stripping and to clean other bobbins so they are ready for packing for reuse.

SUMMARY OF THE INVENTION

The present invention fulfills this need in the art by providing a stripped bobbin treatment apparatus for inspecting, cleaning and packing bobbins which have been stripped of residual yarn. The apparatus includes a conveyor for conveying stripped bobbins, an inspection station traversed by the conveyor at which bobbins which are not completely stripped may be redirected to a stripper for additional stripping and bobbins which are damaged may be discarded. Downstream thereof are a cleaning station traversed by the conveyor and at which the stripped bobbins may be cleaned and a packing station traversed by the conveyor and at which bobbins may be removed from the conveyor for packing into transport containers.

Preferably, the conveyor includes a plurality of endless circular-cross section belts trained around sheaves which permit the bobbins to travel in non-linear paths on the conveyor Desirably, the cleaning station includes a housing through which the conveyor traverses in a path and nozzles adapted to spray water towards the path to clean the bobbins travelling through the housing on the conveyor. Preferably, the nozzles include nozzles disposed laterally of the conveyor to spray water inwardly toward the path. In a preferred embodiment the cleaning station includes a blower downstream of the nozzles to blow drying air onto the bobbins. Desirably, the cleaning station includes side rails adjacent the conveyor where the conveyor traverses the cleaning station to hold bobbins on the conveyor when impacted by water sprays in the cleaning station. The side rails may be located over a lower bobbin flange as the bobbins are transported through the cleaning station on the conveyor.

In a preferred embodiment the cleaning station includes an upper belt vertically aligned with the conveyor and spaced from the conveyor a distance about the height of the bobbins to hold the bobbins onto the conveyor. Desirably, the cleaning station includes a support under the conveyor to support the conveyor and conveyed bobbins and a lower nozzle positioned below the conveyor and aligned with a hole in the support to permit cleaning water to be directed by the nozzle against the bottom of the bobbin.

The invention also provides a stripped bobbin washer for cleaning bobbins which have been stripped of residual yarn. The washer includes a conveyor for conveying stripped bobbins, a housing through which the conveyor traverses in a path, nozzles in the housing adapted to spray water towards the path to clean the bobbins travelling through the housing on the conveyor and an upper belt in the housing vertically aligned with the conveyor and spaced from the conveyor a distance about the height of the bobbins to hold the bobbins onto the conveyor even under strong water pressure impacting the bobbins from the nozzles. The nozzles may include nozzles disposed laterally of the conveyor to spray water inwardly toward the path. Preferably nozzles are mounted for pivoting reciprocation in a plane substantially perpendicular to the path. Also, nozzles may be mounted for pivoting reciprocation in a substantially horizontal plane substantially parallel to the path. Desirably, both types of nozzles are included.

Preferably, lower nozzles are mounted for rotation about a substantially vertical axis and located below the path to spray water upwardly through bobbins passing through the housing.

Preferably, the upper belt has a downwardly urged lower run. Preferably, the housing includes a support member above the lower run which supports downwardly urged rollers contacting the lower run to yieldingly urge the lower run into contact with bobbins traversing the housing on the conveyor. Desirably, the rollers are spaced apart approximately the width of a bobbin.

Also preferably, a blower downstream of the nozzles blows drying air onto the bobbins.

The apparatus preferably includes side rails adjacent the conveyor where the conveyor traverses the housing to hold bobbins on the conveyor when impacted by water sprays in the housing. Desirably, the side rails are located over a lower bobbin flange as the bobbins are transported through the housing on the conveyor.

In a preferred embodiment, the housing includes a support under the conveyor to support the conveyor and conveyed bobbins, the lower nozzle is positioned below the conveyor and aligned with a hole in the support to permit cleaning water to be directed by the nozzle against the bottom of the bobbin. Preferably, the lower nozzle is mounted for rotation around a vertical axis and includes a plurality of nozzle outlets directed upwardly and towards the axis.

The invention also provides a method of reconditioning bobbins which have been stripped of residual yarn including the steps of inspecting stripped bobbins and as a result of such inspection, redirecting bobbins which are not completely stripped to a stripper for additional stripping and discarding bobbins which are damaged, cleaning the stripped bobbins, and packing the stripped bobbins into transport containers. The method preferably includes conveying the bobbins on a conveyor to permit the inspecting, cleaning and packing steps to be performed in a non-linear path. Preferably, the cleaning step includes positioning an upper bobbin restraint above the bobbins to hold the bobbins onto the conveyor.

Desirably, the cleaning step includes conveying the bobbins into a housing and spraying water towards the bobbins to clean the bobbins in the housing. The spraying step may include spraying water inwardly toward the bobbins. Desirably, the cleaning step includes blowing drying air onto the bobbins. In a preferred embodiment the cleaning step includes holding the bobbins upright when impacted by water sprays. This preferably includes restraining a lower bobbin flange.

The invention also provides a method of cleaning bobbins which have been stripped of residual yarn including conveying stripped bobbins on a path, surrounding the conveyed stripped bobbins with a housing through which the path traverses, spraying water towards bobbins on the path to clean the bobbins travelling through the housing and holding the bobbins down so they are conveyed even under strong water pressure impacting the bobbins.

The method may include the cleaning features related above with respect to the method of reconditioning. It may also include reciprocally pivoting a spray of water in a plane substantially perpendicular to the path and/or reciprocally pivoting a spray of water in a substantially horizontal plane substantially parallel to the path. Desirably, the spraying step includes rotating a lower nozzle about a substantially vertical axis below the path to spray water upwardly through bobbins.

BRIEF DESCRIPTION OF THE DRAWINGS

The invention will be better understood from a reading of the Detailed Description of the Preferred Embodiments along with a study of the drawings in which:

FIG. 2 is a perspective view of a conveyor useful in the present invention;

FIG. 3 is a side sectional view of the conveyor depicted in FIG. 2;

DETAILED DESCRIPTION OF THE PREFERRED EMBODIMENTS

Figure 1:
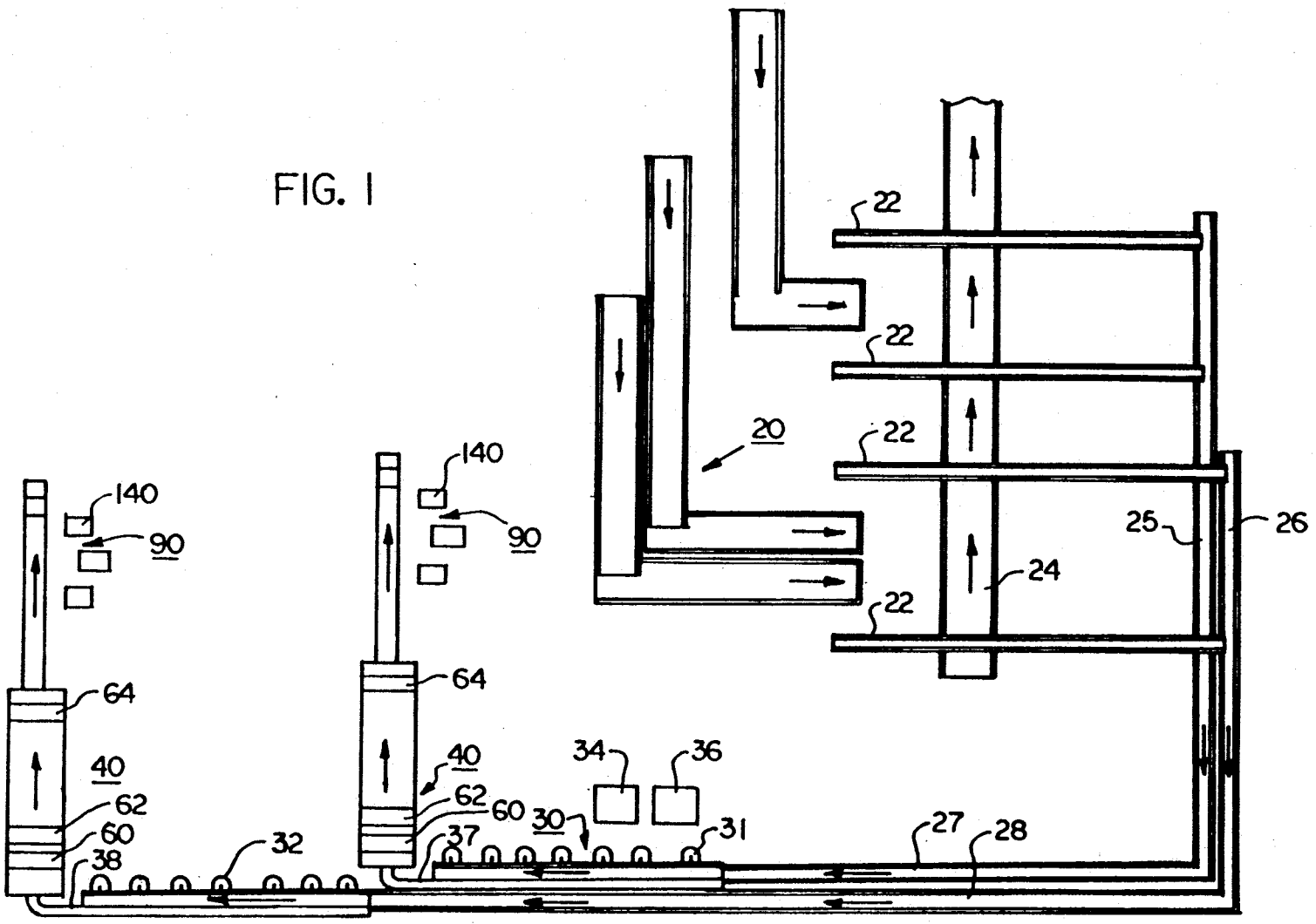
FIG. 1 is a plan view of a facility for bobbin reconditioning.

FIG. 1 illustrates a plan view of a facility layout for bobbin stripping and reconditioning according to a preferred embodiment of the invention. It includes a bobbin stripping area 20, an inspection area 30, a cleaning area 40 and a packing area 90. As described in applicant's U.S. Pat. No. 4,965,917, bobbins with residual yarn to be stripped are loaded onto a conveyor 22 past a bobbin stripping station, not shown. The stripped yarn is carried away on a conveyor 24 and the cleaned bobbin is conveyed to a clean bobbin conveyor 26. As shown in FIG. 1, four different bobbin stripping lines 22 are provided, for handling large volumes of bobbins. As shown in FIG. 1, two of the stripping lines 22 deposit their bobbins onto one conveyor 26 and two others deposit theirs onto another conveyor 25. Conveyors 25 and 26, in turn, deposit their bobbins onto further conveyors 27 and 28, which carry the bobbins into the inspection area 30.

The inspection area 30 includes a plurality of inspection work stations 31,32 at which workers are stationed to pick up bobbins from the respective conveyors 27,28. Cartons 34,36 are provided adjacent the work stations 31 into which the workers can place bobbins which do not meet certain criteria. For example, if the bobbin still has residual yarn, so that further stripping is required, the inspector may place the bobbin in carton 34. If the bobbin is damaged, so that further winding of yarn on the bobbin would damage the yarn or cause it not to process properly, the bobbin can be placed in carton 36 for disposal. The bobbins in carton 34 can be reintroduced to one of the bobbin stripping lines 22.

As will be appreciated, the number of inspectors needed to be positioned along the bobbin inspection areas 30 at inspection stations 31,32 will depend upon the rate of movement of the bobbins through that area so that all of the bobbins are inspected efficiently.

Bobbins which have been adequately stripped and which are suitable for reuse are positioned by the inspector on further conveyors 37,38. Each of conveyors 37,38 are substantially identical, so that only one will be described, along with the downstream rinse stations 40 and packing stations 90.

As seen in FIG. 2, the conveyor 37 includes a supporting frame 42 having inwardly disposed thereof low friction ultra high molecular weight plastic guides 44. The guides 44 have grooves 46 formed therein. The actual conveying surface of the conveyor is provided by a plurality of cylindrically cross-sectional belts 48, as seen in FIG. 2. Four belts 48 all travel in the same direction in the view of FIG. 2 and ride in the grooves 46 of the guides 44. The guides 46 are shallow enough so that the belts 48 protrude above the surface of the guides and form a moving upper surface on which the bobbins 50 can readily ride.

A unique feature of the conveyor design of this type is the ability of the conveyed articles to turn corners. This capability is provided by the fact that the belt 48 is tensioned to turn around sheaves 52 rotatably mounted to cause the belt 48 to change direction, in the same plane, around the sheaves 52. The belts 48 travel a return path underneath the supporting frame 42 and make the turn back toward the starting point of the conveyor line on a sheave journaled in bearing 54.

The belt 48 is driven by a drive motor underneath the support 42, not shown. As can be seen in FIG. 2, the support 42 also includes lower side rails 53 and upper side rails 56. The lower side rails 53 are positioned so as to overline a sideways extending flange 58 on the bobbin 50 and thereby assure that the bobbin does not fall laterally. The upper rails 56 are provided to help assure that the full upper extent of the bobbin makes the turn on the belts 48.

The turn is typically done at 45 degree increments, so that two 45 degree turns suffice to make a 90° turn in the direction of travel of the bobbins. As seen in FIG. 3, the sheave 52 is rotatably mounted in the support frame 42 and has an upper configuration such that the turning of the belt around the top of the sheave is effected without slippage of the belt off of the sheave, but without also obscuring the contact between the bobbin and the belt as it turns about the sheave.

The conveyor takes the bobbins into the wash unit 40. The wash unit 40 includes a horizontal exterior and interior wash area 60, a vertical exterior wash area 62, and a blower drying area 64. The areas can be seen better in FIGS. 4, 5 and 6. The conveyor 48 continues through a housing encapsulating the wash unit to contain the water sprayed in the wash unit. The actual containing surfaces of the wash unit are not shown in FIGS. 4 and 5, for the purposes of clarity, but can conveniently be sheet metal affixed to the support frame elements. Support elements 66 are provided to provide a supporting frame for the conveyor 48 as well as the other components as described herein. The support elements are desirably painted square steel tubing.

Figure 5:
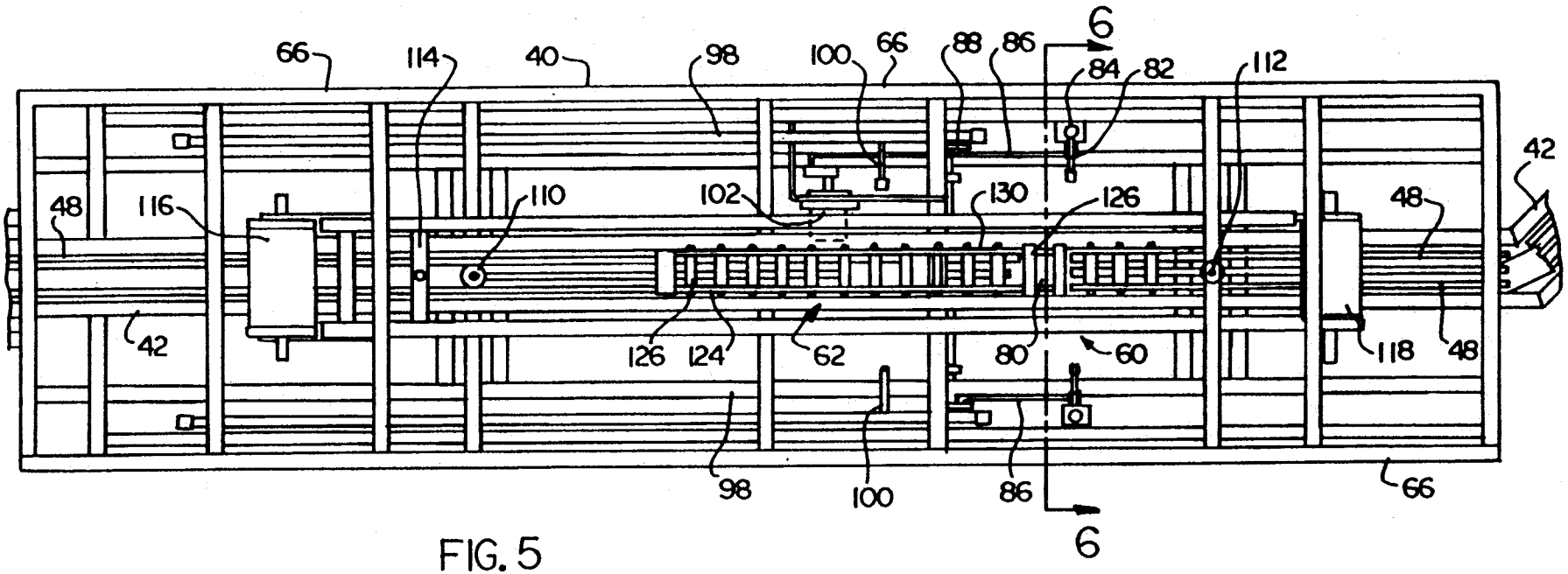
FIG. 5 is a top view of the bobbin washing component of the facility depicted in FIG. 1, with portions broken away.
Figure 6:
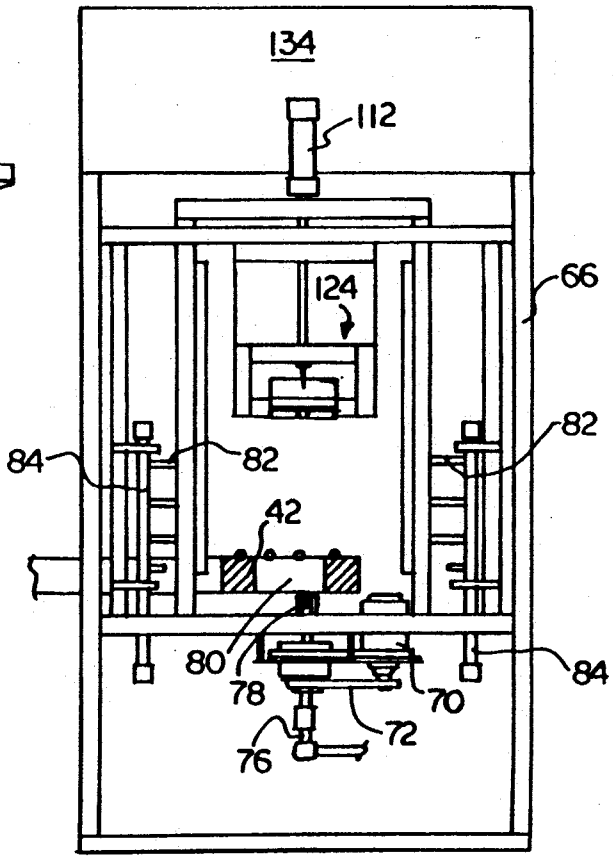
FIG. 6 is a sectional view of the bobbin washing component of the facility depicted in FIG. 1 taken along lines 6-6 looking in the direction of the arrows, with portions broken away.
Figure 7:
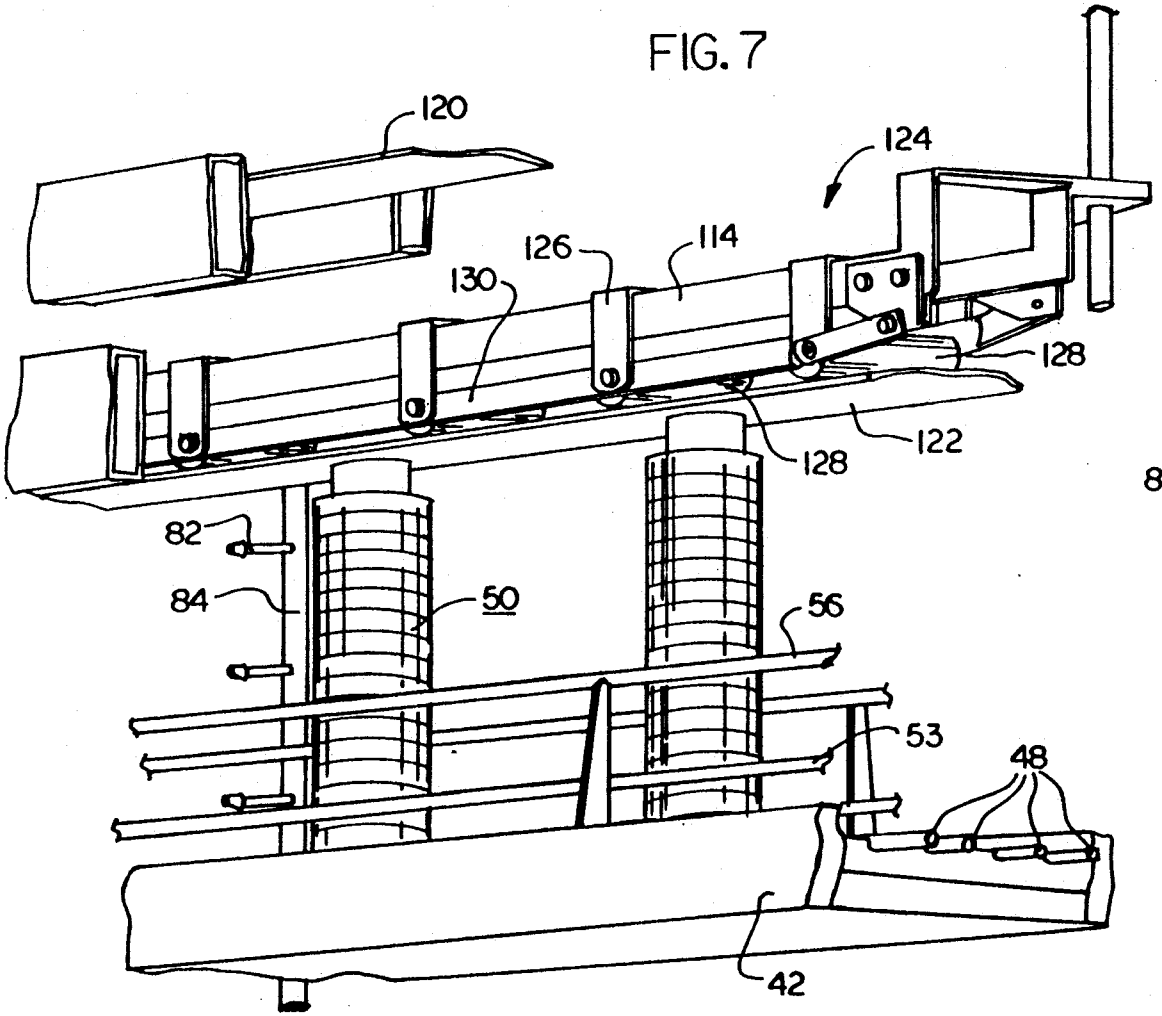
FIG. 7 is a perspective view of the upper belt system shown in FIGS. 4,5 and 6.
Figure 8:
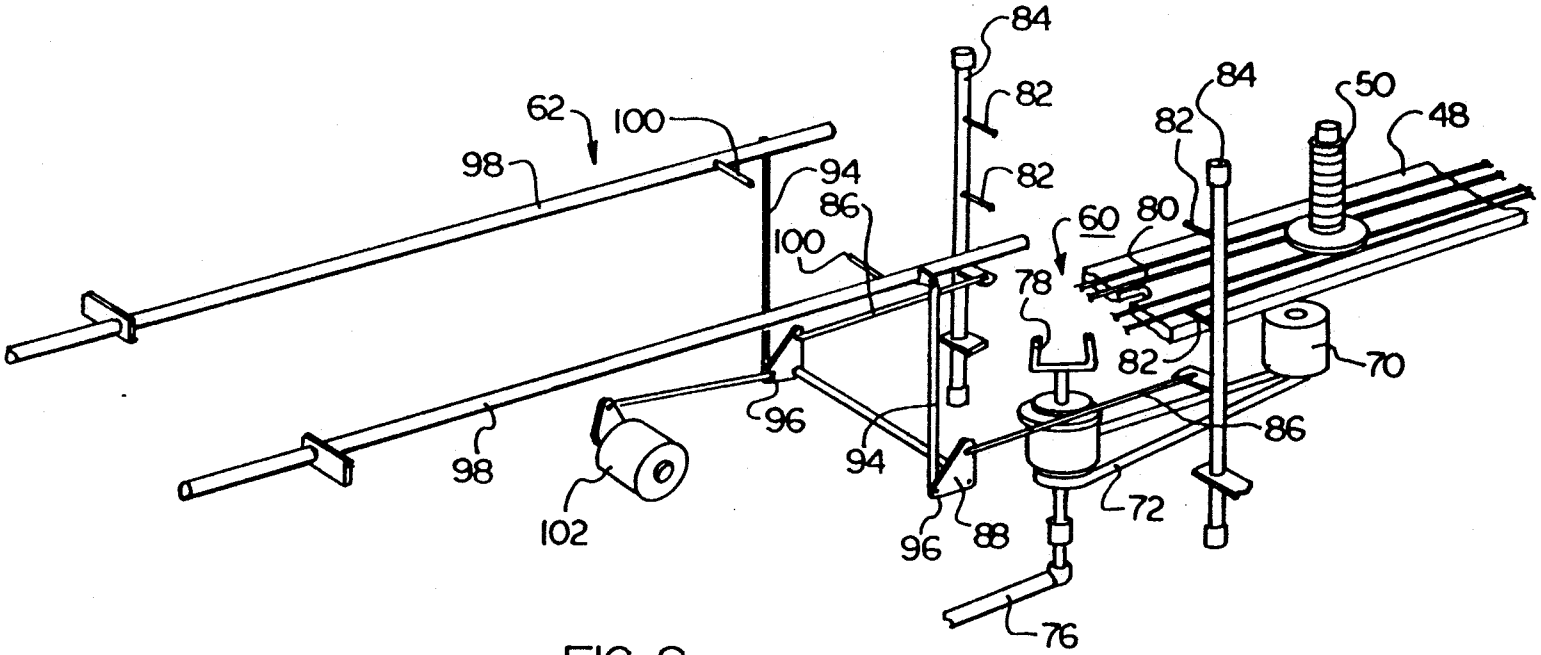
FIG. 8 is a perspective view of the horizontal spray, lower spray, and vertical spray units of the bobbin washing component, shown separated from the housing, for clarity.
Figure 9:
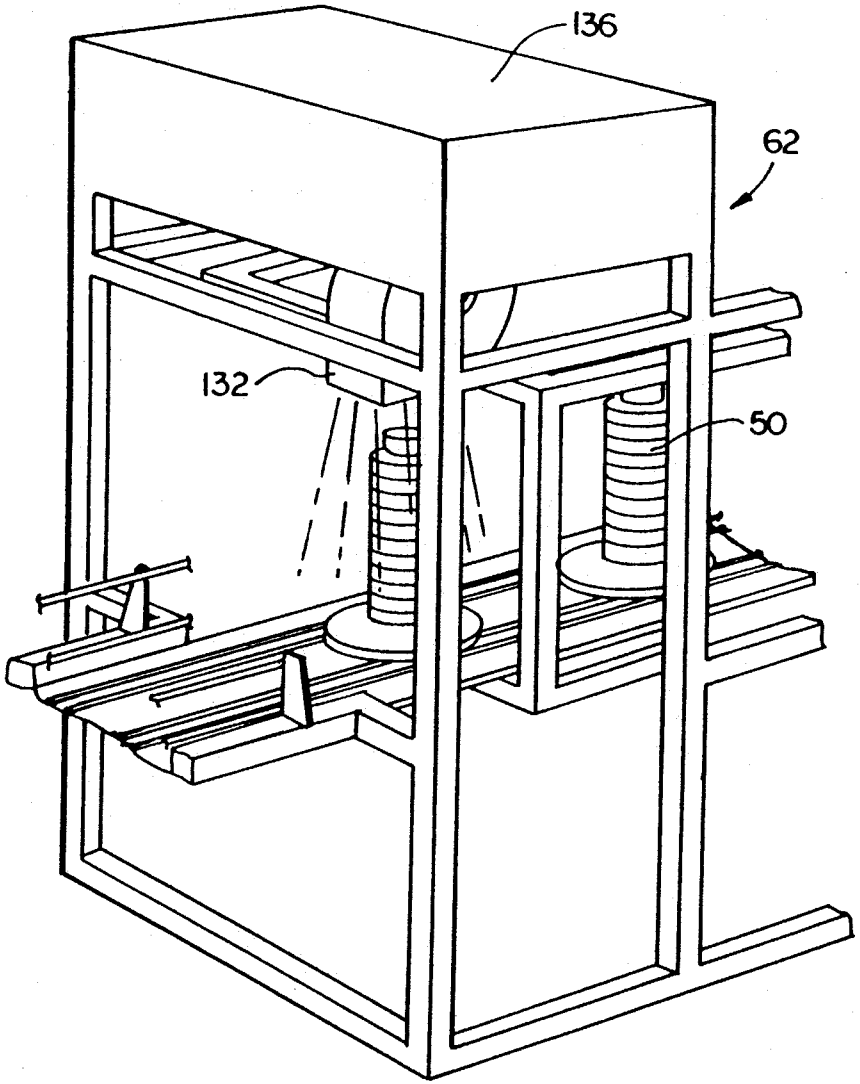
FIG. 9 is a perspective view of the blower area of the bobbin washing component.

The support 66 also supports longitudinal bars 68 which support a hydraulic motor 70. Motor 70 drives by a V-belt 72, a pulley on a hollow axle 74 which connects a pressurized water supply 76 and a pair of inwardly turned nozzles 78. The nozzles 78 are turned inwardly so as to provide a converging, but upwardly directed water stream which will enter the hollow center of a bobbin 50 as it is carried over the nozzles 78 by the conveyor 48. As can be seen in FIG. 5, the support plate guides 44 have a gap 80 just above the nozzles 78 to permit the water to pass up into the bobbin.

Mounted to either side of the conveyor are additional nozzles. A first set of nozzles 82 are provided at intervals along a vertically extending pipe 84. Pipe 84 is journaled for rotation about a vertical axis, so that upon rotation of the pipe 84, the nozzles 82 sweep in a horizontal plane parallel to the path of the bobbins. The pipe 84 is supplied with pressurized water through suitable piping, not shown. The pipe 84 is caused to oscillate in a bearing mount by a crank arm 86 pivotally connected to a triangular plate 88 which, in turn, is pivotally mounted at 92 to the frame 66 of the wash unit. A similar crank arm 94 is pivotally mounted to corner 96 of the triangular plate and, in turn, links to a pipe 98 pivotally mounted in the frame 66 for rotation about a horizontal axis, generally parallel with the path of the bobbins through the apparatus. Thus, nozzles 100 joined to the pipe 98 oscillate in a vertical plane substantially perpendicular to the path of travel of the bobbins when the crank arm 94 is oscillated.

Motor 102 is provided with an eccentric 103 driving a rod 105 connected to the triangular plate 88. Thus, as the motor turns, the plate 88 rocks back and forth to thereby cause the nozzles 82 and nozzles 100 to continually oscillate. As the bobbins enter the wash unit 40, they are washed at stage 60 by the lower rotating nozzles 78 and the nozzle 82 oscillating in a plane substantially parallel with the path of travel. Downstream thereof at the station 62, the bobbins are washed by nozzles 100 oscillating in a plane substantially perpendicular to the path of travel.

Figure 4:
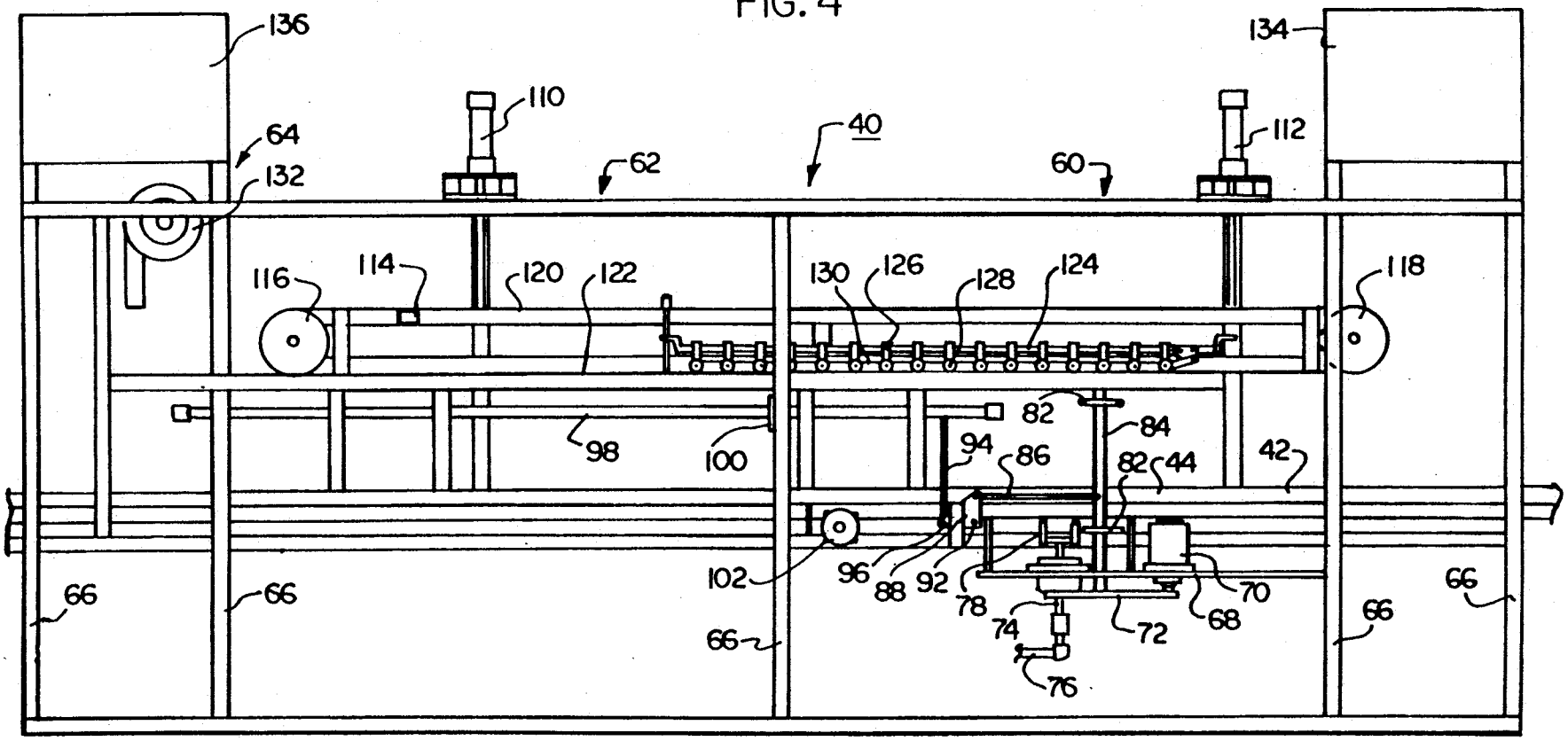
FIG. 4 is a side view of the bobbin washing component of the facility depicted in FIG. 1, with portions broken away.

The bobbins remain in position on the conveyor 48 because of the rails 54 described previously which extend over the conveyor through the wash zone, although they are not shown in FIGS. 4 and 5 for the sake of clarity.

Furthermore, a hold-down apparatus is provided to contact the tops of the bobbins to assure that they do not get dislodged, even under the relatively high water pressures to which they may be subjected by the various nozzles. Suspended from the support frame 66 through positioning cylinder 110,112 is an intermediate frame 114 having rollers 116,118 journaled in its distal ends. Disposed about the rollers is a belt 120 having a lower run 122.

Also provided on the frame 114 is a secondary frame 124 including a plurality of short, channel-shaped pieces 126 having rollers 128 journaled in them. The rollers 128 are held apart by pivotally linked spacer members 130. Rollers 128 are urged downwardly against the lower run 122 of the belt 120 by the weight of the roller assy. Downward travel is limited when roller holder 126 contacts frame 114. The precise location of the lower run 122 may be adjusted, as desired, by adjusting the cylinders 110,112. The lower run 122 is preferably positioned to be somewhat below the tops of the bobbins as they stand on the conveyor belt 48, so that the tops of the bobbins will come into contact with the lower run 122, with the springs urging the rollers 128 downwardly to provide a compressive force to the tops of the bobbins.

The rollers are provided spaced apart about the same distance as the smallest of the bobbins expected, to assure that the bobbins receive solid downward support as they pass through the apparatus, particularly in the region of the nozzle 78, which exerts substantial upward pressure.

The belt 122 is desirably driven in synchronization with the belt 48, by a motor drive, not shown.

Downstream of the wash zone 62 is the air drying zone 64 in which a blower 132 blows air downwardly onto the bobbins to blow water therefrom and to provide substantial drying of the bobbins.

At the bottom of the support frame member 66, the housing forms a water-tight tank (not shown for clarity) to collect the water sprayed by the various nozzles and collect it for recycling, through appropriate filtering. Desirably, a high pressure water pump unit 134 can be mounted on the upper portion of the frame to serve this purpose.

A hydraulic pressure system 136 can be provided on the upper portion of the downstream end of the frame to provide hydraulic pressure for the hydraulic motor 70 and appropriate hydraulic motors for the belt 120 and the various cylinders 102,110,112.

Referring again to FIG. 1, downstream of the washing zone 40, the packing zone 90 is provided at which workers may be located to take the cleaned and dried bobbins off of the conveyor 48 and pack them into suitable transport containers such as corrugated cardboard boxes 140.

Thus, the bobbins being packed in the cartons 140 have had the residual yarn stripped away therefrom. Also, they have been inspected in the inspection area to be sure that they are free of residual yarn and to be sure that they are free of defects. In the wash zone, dirt, including such items as previous identification labels and disks have been removed, so that clean bobbins are packed in the cartons 140 for shipment and reuse by a yarn manufacturer.

As will be appreciated, numerous variations in the apparatus and the method can be thought of by those of ordinary skill in the art, all falling within the scope of the present invention.

What is claimed is:

1. A stripped bobbin treatment apparatus for inspecting, cleaning and packing bobbins which have been stripped of residual yarn comprising a conveyor for conveying stripped bobbins;

an inspection station traversed by said conveyor and at which bobbins which are not completely stripped may be redirected to a stripper for additional stripping and at which bobbins which are damaged may be discarded;

a cleaning station traversed by said conveyor and at which the stripped bobbins may be cleaned including a housing and nozzles and an upper belt in said housing vertically aligned with said conveyor and spaced from said conveyor a distance about the height of the bobbins to hold the bobbins onto the conveyor even under strong water pressure impacting the bobbins from the nozzles; and a packing station traversed by said conveyor and at which bobbins may be removed from said conveyor for packing into transport containers.

2. An apparatus as claimed in claim 1 wherein said conveyor comprises a plurality of endless circular-cross section belts trained around sheaves which permit the bobbins to travel in non-linear paths on said conveyor.

3. An apparatus as claimed in claim 1 wherein said nozzles include nozzles disposed laterally of said conveyor to spray water inwardly toward said path.

4. An apparatus as claimed in claim 1 wherein said cleaning station comprises a blower downstream of said nozzles to blow drying air onto the bobbins.

5. An apparatus as claimed in claim 1 wherein said cleaning station comprises side rails adjacent said conveyor where said conveyor traverses said cleaning station to hold bobbins on said conveyor when impacted by water sprays in said cleaning station.

6. An apparatus as claimed in claim 5 wherein said side rails are located over a lower bobbin flange as the bobbins are transported through said cleaning station on said conveyor.

7. An apparatus as claimed in claim 1 wherein said cleaning station comprises a support under said conveyor to support said conveyor and conveyed bobbins, a lower nozzle positioned below said conveyor and aligned with a hole in said support to permit cleaning water to be directed by said nozzle against the bottom of the bobbin.

8. A stripped bobbin washer for cleaning bobbins which have been stripped of residual yarn comprising a conveyor for conveying stripped bobbins, a housing through which said conveyor traverses in a path, nozzles in said housing adapted to spray water towards said path to clean the bobbins travelling through said housing on said conveyor, side rails adjacent said conveyor where said conveyor traverses said housing and located over a lower bobbin flange as the bobbins are transported through said housing to hold bobbins on said conveyor when impacted by water sprays in said housing, and an upper belt in said housing vertically aligned with said conveyor and spaced from said conveyor a distance about the height of the bobbins to hold the bobbins onto said conveyor even under strong water pressure impacting the bobbins from said nozzles.

9. An apparatus as claimed in claim 8 wherein said conveyor comprises a plurality of endless circular-cross section belts trained around sheaves which permit the bobbins to travel in non-linear paths on said conveyor.

10. An apparatus as claimed in claim 8 wherein said nozzles include nozzles disposed laterally of said conveyor to spray water inwardly toward said path.

11. An apparatus as claimed in claim 10 wherein said nozzles are mounted for pivoting reciprocation in a plane substantially perpendicular to said path.

12. An apparatus as claimed in claim 10 wherein said nozzles are mounted for pivoting reciprocation in a substantially horizontal plane substantially parallel to said path.

13. An apparatus as claimed in claim 10 wherein ones of said nozzles are mounted for pivoting reciprocation in a plane substantially perpendicular to said path and other ones of said nozzles are mounted for pivoting reciprocation in a substantially horizontal plane substantially parallel to said path.

14. An apparatus as claimed in claim 13 further comprising lower nozzles mounted for rotation about a substantially vertical axis and located below said path to spray water upwardly through bobbins passing through said housing.

15. An apparatus as claimed in claim 8 wherein said upper belt has a downwardly urged lower run.

16. An apparatus as claimed in claim 8 wherein said nozzles are mounted for rotation about a substantially vertical axis and are located below said path to spray water upwardly through bobbins passing through said housing.

17. An apparatus as claimed in claim 8 further comprising a blower downstream of said nozzles to blow drying air onto the bobbins.

18. An apparatus as claimed in claim 8 wherein said upper belt has a lower run and said housing comprises a support member above said lower run include downwardly urged rollers contacting said lower run to yieldingly urge said lower run into contact with bobbins traversing said housing on said conveyor.

19. An apparatus as claimed in claim 18 wherein said rollers are spaced apart approximately the width of a bobbin.

20. An apparatus as claimed in claim 8 wherein said housing comprises a support under said conveyor to support said conveyor and conveyed bobbins, a lower nozzle positioned below said conveyor and aligned with a hole in said support to permit cleaning water to be directed by said nozzle against the bottom of the bobbin.

21. An apparatus as claimed in claim 20 wherein said nozzle is mounted for rotation around a vertical axis and comprises a plurality of nozzle outlets directed upwardly and towards said axis.

22. A stripped bobbin treatment apparatus for inspecting, cleaning and packing bobbins which have been stripped of residual yarn comprising a. a conveyor for conveying stripped bobbins in the form of a plurality of endless circular-cross section belts trained around sheaves which permit the bobbins to travel in non-linear paths on said conveyor;

b. an inspection station traversed by said conveyor and at which bobbins which are not completely stripped may be redirected to a stripper for additional stripping and at which bobbins which are damaged may be discarded;

c. a cleaning station traversed by said conveyor and at which the stripped bobbins may be cleaned including 1) a housing through which said conveyor traverses in a path;

2) nozzles in said housing adapted to spray water towards said path to clean the bobbins travelling through said housing on said conveyor, including a) nozzles mounted for pivoting reciprocation in a plane substantially perpendicular to said path, b) nozzles mounted for pivoting reciprocation in a substantially horizontal plane substantially parallel to said path and c) lower nozzles mounted for rotation about a substantially vertical axis and located below said path to spray water upwardly through bobbins passing through said housing;

3) a support under said conveyor in said housing to support said conveyor and conveyed bobbins, said lower nozzles positioned below said conveyor and aligned with a hole in said support to permit cleaning water to be directed by said lower nozzles against the bottom of the bobbin;

4) side rails adjacent said conveyor where said conveyor traverses said housing and located over a lower bobbin flange as the bobbins are transported through said housing on said conveyor to hold bobbins on said conveyor when impacted by water sprays in said housing;

5) an upper belt in said housing vertically aligned with said conveyor and spaced from said conveyor a distance about the height of the bobbins to hold the bobbins on said conveyor even under strong water pressure impacting the bobbins from said nozzles and having a lower run, said housing including a support member above said lower run supporting downwardly urged rollers spaced apart approximately the width of a bobbin contacting said lower run to yieldingly urge said lower run into contact with bobbins traversing said housing on said conveyor; and 6) a blower downstream of said nozzles to blow drying air onto the bobbins;

d. a packing station traversed by said conveyor and at which bobbins may be removed from said conveyor for packing into transport containers.

* * * * *